US009999796B2

(12) United States Patent
Leipheimer

(10) Patent No.: US 9,999,796 B2
(45) Date of Patent: Jun. 19, 2018

(54) SUPPLEMENTAL WEIGHT STACK FOR AN EXERCISE MACHINE

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 63 days.

(21) Appl. No.: 14/851,573

(22) Filed: Sep. 11, 2015

(65) Prior Publication Data

US 2016/0074688 A1 Mar. 17, 2016

Related U.S. Application Data

(60) Provisional application No. 62/049,396, filed on Sep. 12, 2014.

(51) Int. Cl.

| | |
|---|---|
| ***A63B 21/00*** | (2006.01) |
| ***A63B 21/062*** | (2006.01) |
| ***A63B 71/00*** | (2006.01) |

(52) U.S. Cl.

CPC .. *A63B 21/00065* (2013.01); *A63B 21/00069* (2013.01); *A63B 21/063* (2015.10); *A63B 21/0628* (2015.10); *A63B 71/0054* (2013.01); *A63B 2071/0063* (2013.01)

(58) Field of Classification Search

CPC ..... A63B 21/062–21/0632; A63B 21/075

See application file for complete search history.

(56) References Cited

U.S. PATENT DOCUMENTS

| | | | | |
|---|---|---|---|---|
| 5,417,630 | A * | 5/1995 | Schultz | A63B 21/154 482/70 |
| 5,643,152 | A | 7/1997 | Simonson | |
| 6,193,635 | B1 * | 2/2001 | Webber | A63B 21/0628 482/138 |
| 7,252,627 | B2 | 8/2007 | Carter | |
| 7,335,139 | B2 | 2/2008 | Bartholomew et al. | |
| 7,413,532 | B1 | 8/2008 | Monsrud et al. | |
| 7,871,357 | B2 * | 1/2011 | Gibson | A63B 21/0628 482/98 |
| 7,946,968 | B2 * | 5/2011 | Kjellberg | A63B 21/0628 482/100 |
| 8,708,870 | B2 * | 4/2014 | Nalley | A63B 21/075 482/98 |

* cited by examiner

*Primary Examiner* — Loan H Thanh
*Assistant Examiner* — Jennifer M Deichl
(74) *Attorney, Agent, or Firm* — The Webb Law Firm

(57) ABSTRACT

A supplemental weight stack is disclosed. The supplemental weights add a weight load to an exercise machine in increments less than the main weight increments. The supplemental weights can be stacked horizontally and can be designed such that when engaged, each supplemental weight acts upon an engagement mechanism. The user selects the supplemental weight by acting upon an adjustment mechanism, which, in turn, actuates the engagement mechanism.

19 Claims, 15 Drawing Sheets

SUPPLEMENTAL WEIGHT STACK FOR AN EXERCISE MACHINE

CROSS REFERENCE TO RELATED APPLICATIONS

This application claims benefit under 35 U.S.C. § 119(e) of provisional Application Ser. No. 62/049,396, filed Sep. 12, 2014, the contents of which are incorporated herein in their entirety.

BACKGROUND OF THE INVENTION

Field of the Invention

This invention relates generally to exercise machines. More specifically, the invention relates to supplemental weight stacks for exercise machines.

Description of Related Art

Exercise machines are commonplace at many gyms and homes because machines have some advantages over free weight exercises. One advantage is that exercise machines allow users to perform exercises they may not be able to perform with free weights. Another advantage is the machines are often safer than free weights. However, one of the major disadvantages of exercise machines is that the weights increase at a predetermined increment. For example, if each weight in the weight stack is 20 pounds, a user could not increase the weight by 5, 10, or 15 pounds. Likewise, if the weights are in 10 pound increments, a user could not increase the weight by 2.5, 5, or 7.5 pounds.

U.S. Pat. No. 7,413,532 to Monsrud et al. presents one possible solution to this problem by including supplemental weights stacked on top of one another where each weight has a corresponding vertical leg. The user rotates a dial and a spring-loaded pin engages one of the vertical legs. The added weight depends on which vertical leg is selected.

U.S. Pat. No. 7,252,627 to Carter also discloses a supplemental weight stack with vertically stacked weights. This weight stack operates via a wheel with pins spaced unequally from the center. As the wheel is rotated, the pins engage the supplemental weights. The pin furthest from the center corresponds to the highest weight.

The prior art relies on vertically stacked weights and spring-loaded engagement mechanisms. These can lead to safety issues and less stability. Therefore, the present invention is drawn to a more stable, safer supplemental weight stack.

SUMMARY OF THE INVENTION

Generally, it is an object of the present invention to provide a supplemental weight stack system and method that overcomes some or all of the above-described deficiencies of the prior art.

A preferred, but non-limiting, aspect of the invention is a weight system including an engagement mechanism, an adjustment mechanism capable of actuating the engagement mechanism, and, at least one weight adapted to receive the engagement mechanism. The one weight having a top, a bottom, and two sides, and a vertical axis from the top to the bottom, wherein the engagement mechanism traverses the at least one weight in a circular motion substantially perpendicular to the vertical axis.

A preferred, but non-limiting, aspect of the invention further includes a plurality of weights adapted to receive the engagement mechanism, each weight having a top, a bottom, and two sides, and, a vertical axis from the top to the bottom, wherein the engagement mechanism traverses each weight in a circular motion substantially perpendicular to the vertical axis. In this aspect, the engagement mechanism can traverse each weight sequentially. Further, as the engagement mechanism traverses each weight, the weights cumulatively engage the engagement mechanism such that more than one weight acts upon the engagement mechanism.

Another preferred, but non-limiting, aspect of the invention includes a weight system wherein the plurality of weights are stacked horizontally. The weight system can also include at least one stop pin in each of the weights and/or a catch mechanism. The catch mechanism can also include a safety mechanism. The engagement mechanism can include a plurality of teeth which are engageable with a handle.

The present invention also includes a method for engaging a weight stack including the steps of: providing an adjustment mechanism capable of actuating an engagement mechanism, whereby the engagement mechanism is capable of acting upon a plurality of weights; actuating the engagement mechanism via the adjustment mechanism; and engaging at least one weight with the engagement mechanism.

Further, this method can include rotating the adjustment mechanism in a substantially circular motion.

A preferred, but non-limiting, aspect of the invention further includes engaging a second weight with the engagement mechanism, wherein the engagement mechanism acts upon the first and second weights.

DESCRIPTION OF THE INVENTION

Figure 1:
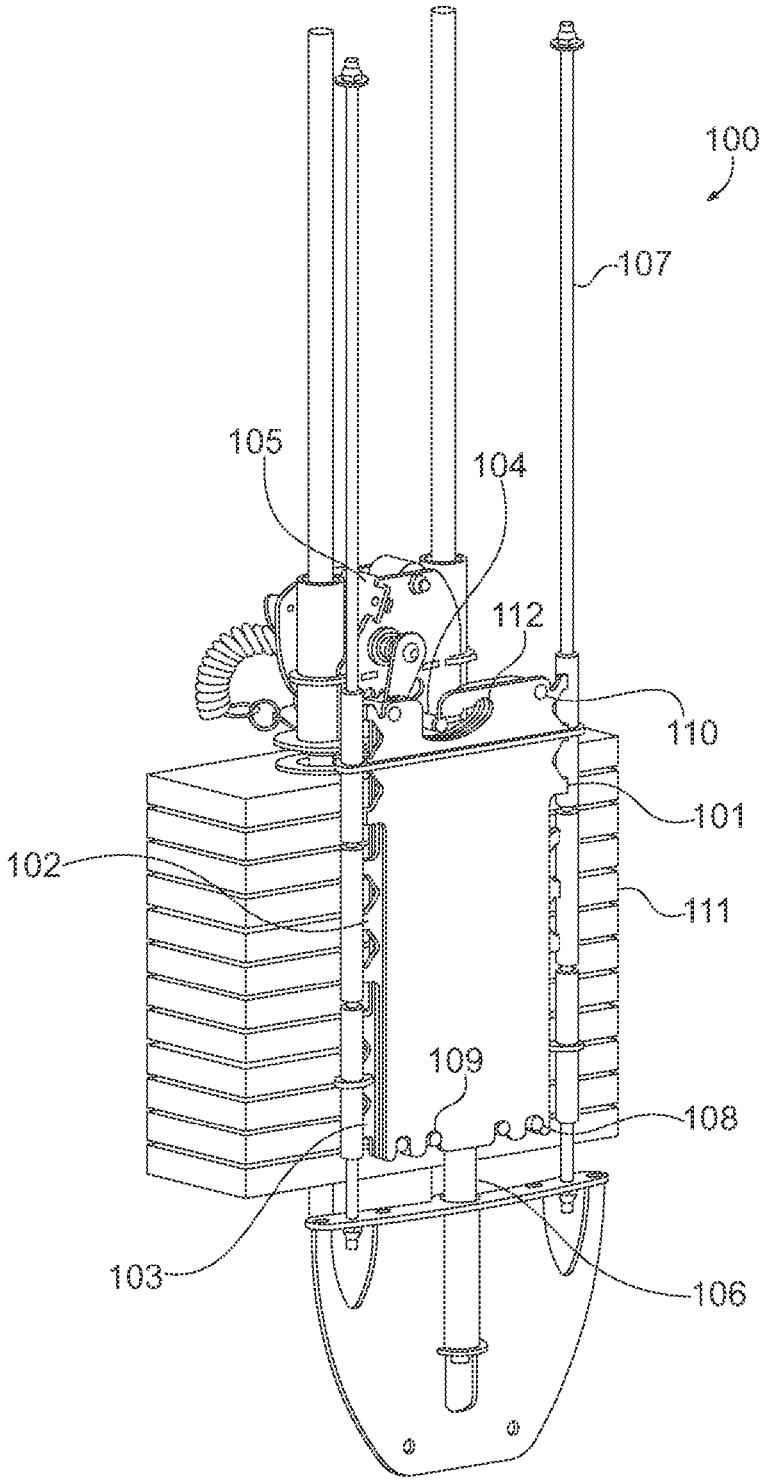
FIG. 1 is a perspective view of a weight stack system in accordance with one aspect of the invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary aspects of the invention. Hence, specific dimensions and other physical characteristics related to the aspects disclosed herein are not to be considered as limiting.

FIG. 1 shows a preferred but non-limiting aspect of the supplemental weight stack system 100. The supplemental weights 101, 102, 103 are located close in proximity to the primary weight stack 111. The weights 101, 102, 103 of the present invention can be stacked horizontally, rather than vertically. The weight stack system 100 also includes an adjustment mechanism 105. The adjustment mechanism 105 actuates an engagement mechanism 104. The engagement mechanism 104 is engageable with a receiver 112. As the adjustment mechanism 105 actuates the engagement mechanism 104, the engagement mechanism 104 engages the receiver 112 of the weights 101, 102, 103. The corresponding weight or weights are then included in the total weight load of the exercise.

In FIG. 1, the adjustment mechanism 105 is shown as a rotatable device, such as a dial. However, the adjustment mechanism 105 can be any device which transfers an input from a user to actuate the engagement mechanism 104. For example, the adjustment mechanism 105 could be a lever, wheel, dial, etc. Further, the adjustment mechanism 105 can lock into place between positions through the use of pins, springs, etc. The engagement mechanism 104 is shown as a rod, but can be any shape which allows the mechanism to engage the receiver 112. For example, if the receiver 112 had a square or rectangular shape, the engagement mechanism 104 would preferably have a similar shape, such as an extruded square rod.

As the engagement mechanism 104 engages with a receiver 112, the corresponding weights 101, 102, 103 are added to the weight load of the exercise. The more receivers 112 that are engaged, the more weights 101, 102, 103 are added. As the user performs the exercise, the added weights 101, 102, 103 move along guides 107. To ensure that the weights 101, 102, 103 return to their original position in the horizontal stack, stop pins 108, 109, 110 can be used. Each weight can have stop pins 108, 109, 110 which correspond to slots in the other weights 101, 102, 103. For example, the stop pin 110 of weight 101 traverses weights 102, 103. The stop pin 109 of weight 102 traverses weight 101. The stop pin 108 of weight 103 traverses weights 101, 102. This ensures that when the weights are returned to their lowered, or resting, position, they align with one another. This is particularly advantageous when the weights are stacked horizontally.

While stop pins 108, 109, 110 are shown as an exemplary aspect in FIG. 1, the weights could use any mechanism which allows the weights to return to their original position relative to one another. For example, the weights 101, 102, 103 could be received within a track or molding rather than the guide 107. In such an aspect, the weights are limited in their range of motion such that, when at their resting position, the weights 101, 102, 103 return to the same position each time. The weights 101, 102, 103 can travel along the guide 107 using any known methods, including the use of wheels, tracks, linear bearings, or rings surrounding the guide 107.

Also in FIG. 1, a catch mechanism 106 is shown at the bottom of the weight stack. The catch mechanism preferably has shock-absorbing qualities such that if any of the weights 101, 102, 103 become disengaged during use, either through user or machine failure, the weights can land softly and reduce the chance of breaking or damaging the weights 101, 102, 103, or the frame of the exercise machine. The catch mechanism 106 can be made of rubber and/or have a spring or gas shock to absorb the impact of falling weights 101, 102, 103.

The weights can be made of any variety of materials including plastics, rubbers, or metal. The choice of material depends on several factors, such as durability and the weight needed. For example, if the weights 101, 102, 103 are each 5 pounds, it may be difficult to make the weights sufficiently heavy and compact using a plastic, which is typically less dense than metal. Likewise, if the weights are small in mass, such as 1.5 pound increments, it may be desirable to use a lighter plastic rather than a denser metal because plastics are often less brittle than a metal. The weights could also be any combination of materials, including a metal frame with a rubber or plastic interior, or vice versa.

Figure 2:
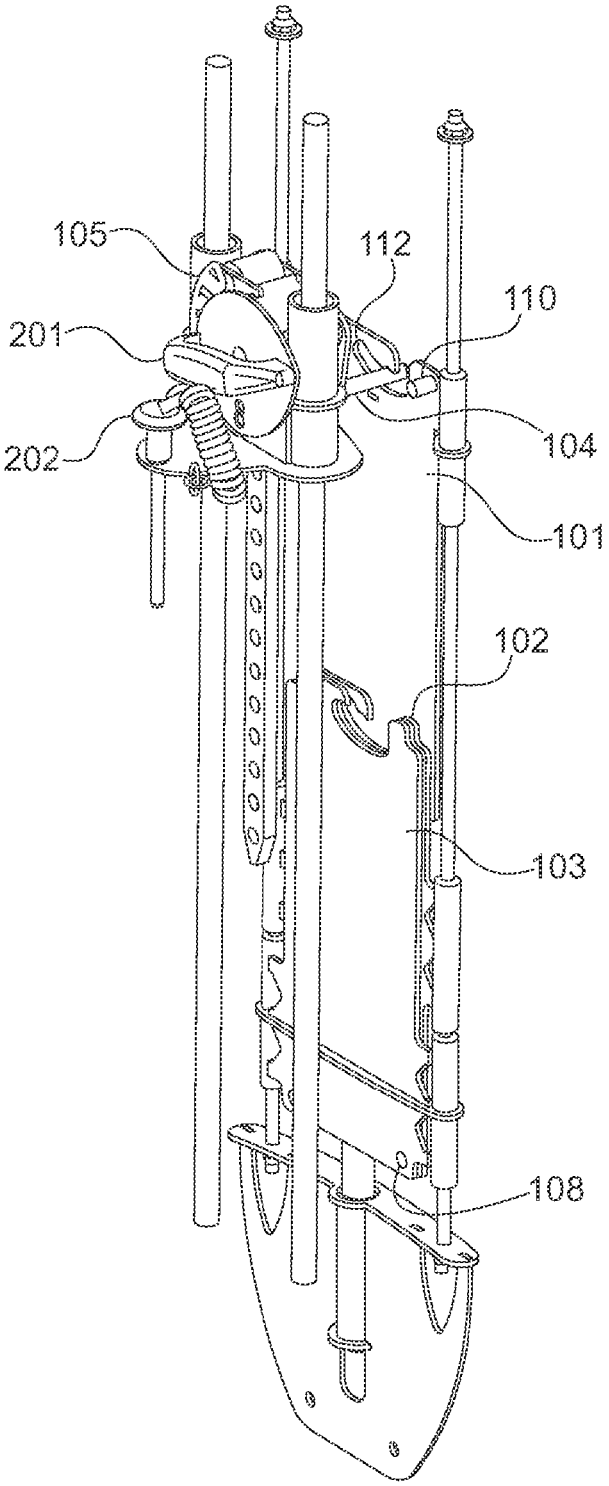
FIG. 2 is a perspective view of a weight stack system in accordance with one aspect of the invention.
Figure 3:
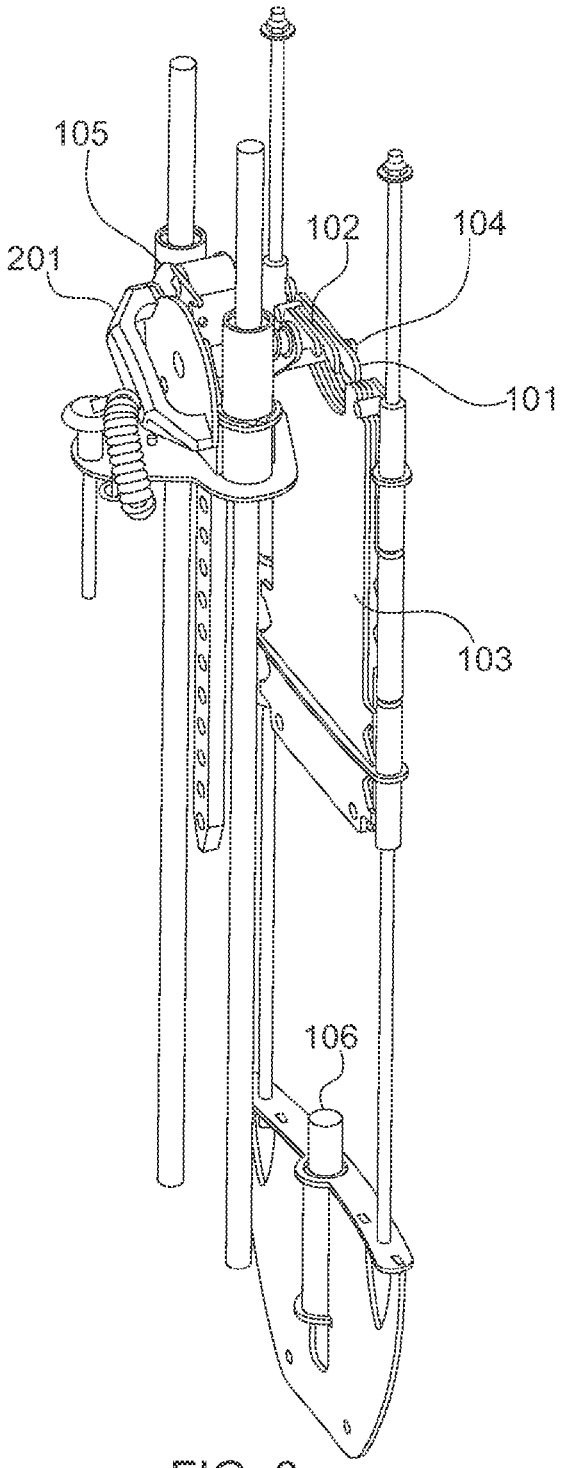
FIG. 3 is a perspective view of a weight stack system in accordance with one aspect of the invention.

FIG. 2 shows the weight system where the engagement mechanism 104 is engaged with a single weight 101. The adjustment mechanism 105 preferably has some sort of device for a user to interact with, such as a handle 201. The shape of the handle 201 will depend on the shape or type of adjustment mechanism 105 used. Also shown is a primary weight stack engagement mechanism 202. The receiver 112 of each weight 101, 102, 103 is preferably shaped so that as the engagement mechanism 104 actuates, the engagement mechanism 104 engages the receivers 112 sequentially. For example, in FIG. 3, the engagement mechanism 104 is shown in engagement with the receivers 112 of all the weights 101, 102, 103. This provides a stronger connection between the engagement mechanism 104 and weights 101, 102, 103. Rather than having all of the weights 101, 102, 103 exert a downward force at a single point, the weights 101, 102, 103 are distributed along the engagement mechanism 104.

Figure 4:
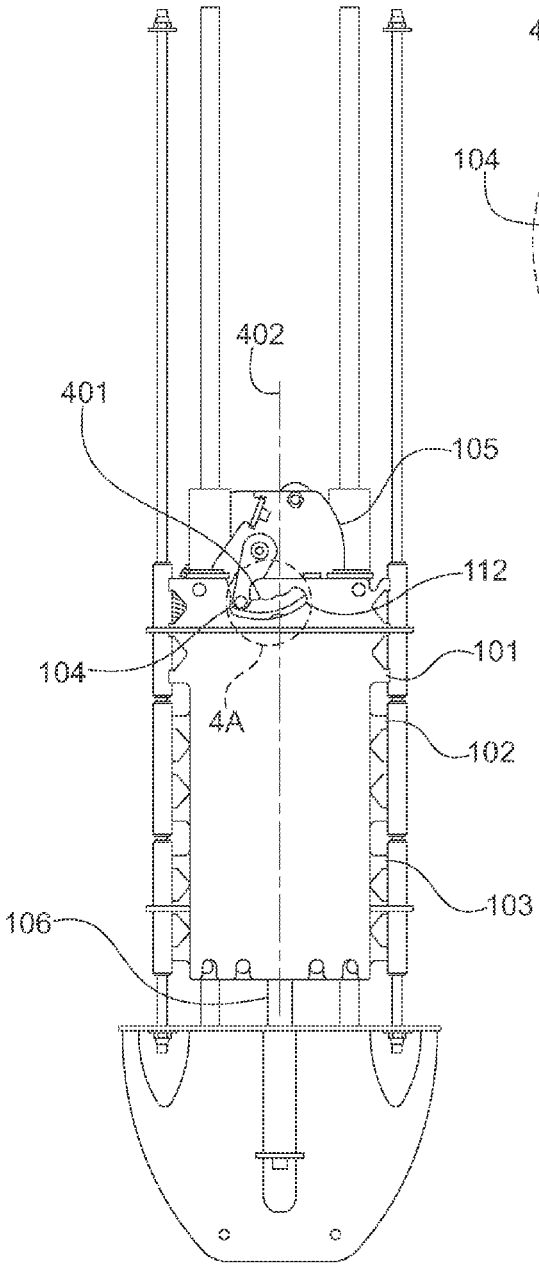
FIG. 4 is a front view of a weight stack system in accordance with one aspect of the invention.
Figure 4A:
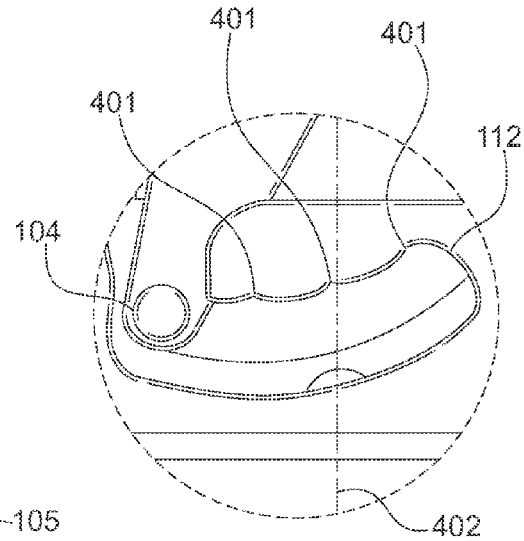
FIG. 4A is a detailed view of one aspect of a weight stack system.
Figure 5A:
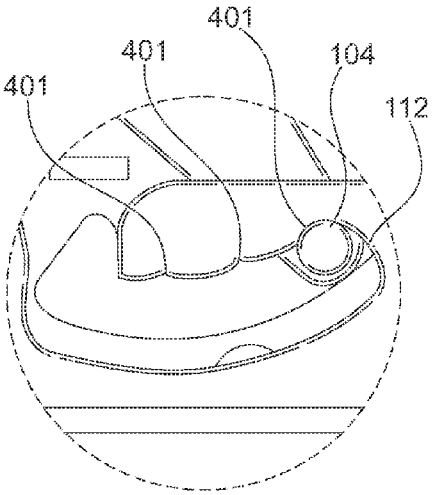
FIG. 5A is a detailed view of one aspect of a weight stack system.
Figure 5:
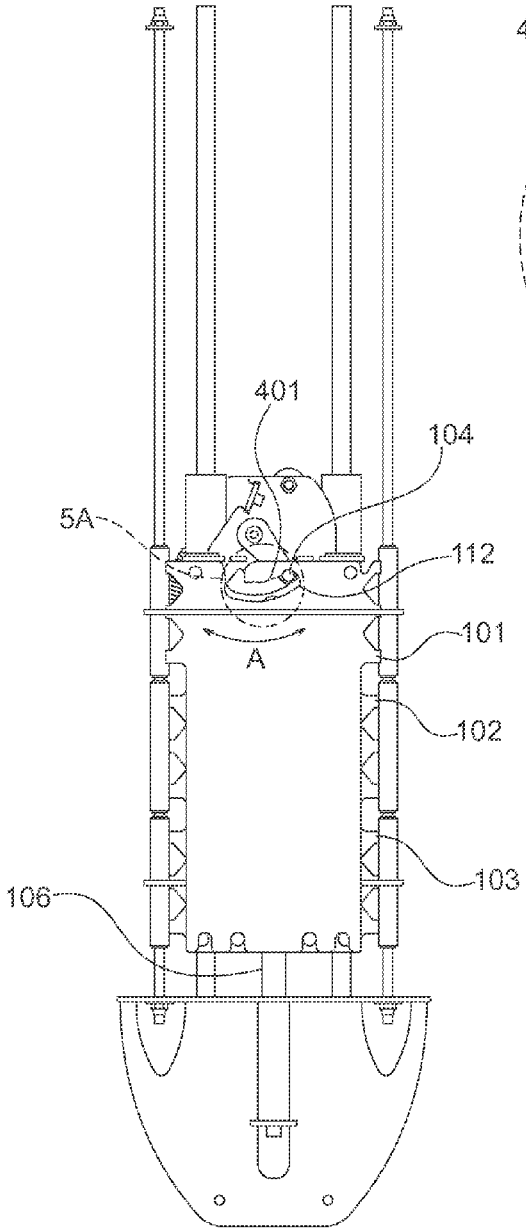
FIG. 5 is a front view of a weight stack system in accordance with one aspect of the invention.

FIGS. 4 and 5 depict the supplemental weights in the resting position. In FIG. 4, none of the weights 101, 102, 103 are engaged by the engagement mechanism 104. In contrast, FIG. 5 depicts all of the supplemental weights 101, 102, 103 in engagement with the engagement mechanism 104. FIGS. 4 and 5 also depict engagement slots 401 for receiving the engagement mechanism 104. Such slots 401 allow for a more secured connection between the engagement mechanism 104 and receiver 112. The engagement slots 401 are preferably shaped like the engagement mechanism 104 such that the engagement mechanism 104 is secured into slots 401 and is kept in the slots 401 through friction and other mechanical forces. A more detailed view of the slots are provided in FIGS. 4A and 5A, which are detailed views of areas 4A and 5A in FIGS. 4 and 5, respectively.

Referring back to FIGS. 4 and 5, the weights 101, 102, 103 can act upon the engagement mechanism 104 individually, or all at once. How the weights 101, 102, 103 act upon the engagement mechanism 104 will depend on factors, such as the shape of the weights 101, 102, 103 and the shape of the receiver 112. In the examples of FIGS. 4 and 5, as more weights 101, 102, 103 are selected, those weights act upon the engagement mechanism 104. In other words, each weight 101, 102, 103 is directly exerting a force upon the engagement mechanism 104. The receiver 112 could be designed, through tapering or the like, such that when a weight is selected, that weight acts upon the engagement mechanism and the other weights act upon the selected weight. The latter example is most common in vertically stacked weights, but horizontally stacked weights could be adapted to use such a mechanism.

FIG. 4 depicts a vertical axis 402. The vertical axis 402 runs from the top of the weights 101, 102, 103 to the bottom through the center. As can be seen from the shape of the receiver 112, a preferred, but non-limiting, aspect is having the engagement mechanism 104 traverse the weights in a direction substantially perpendicular to the vertical axis. In the case where the adjustment mechanism 105 is a handle or wheel, the engagement mechanism 104 can traverse the weights in a circular motion. Direction A in FIG. 5 shows the general movement path of the engagement mechanism 104 shown in the drawings. However, the engagement mechanism 104 can also traverse the weights 101, 102, 103 in a linear motion. This is achieved by using a lever as the adjustment mechanism 105, or converting the circular motion of the adjustment mechanism 105 into a linear motion. This can be accomplished by using any known linear actuator, such as a rack and pinion.

Figure 6:
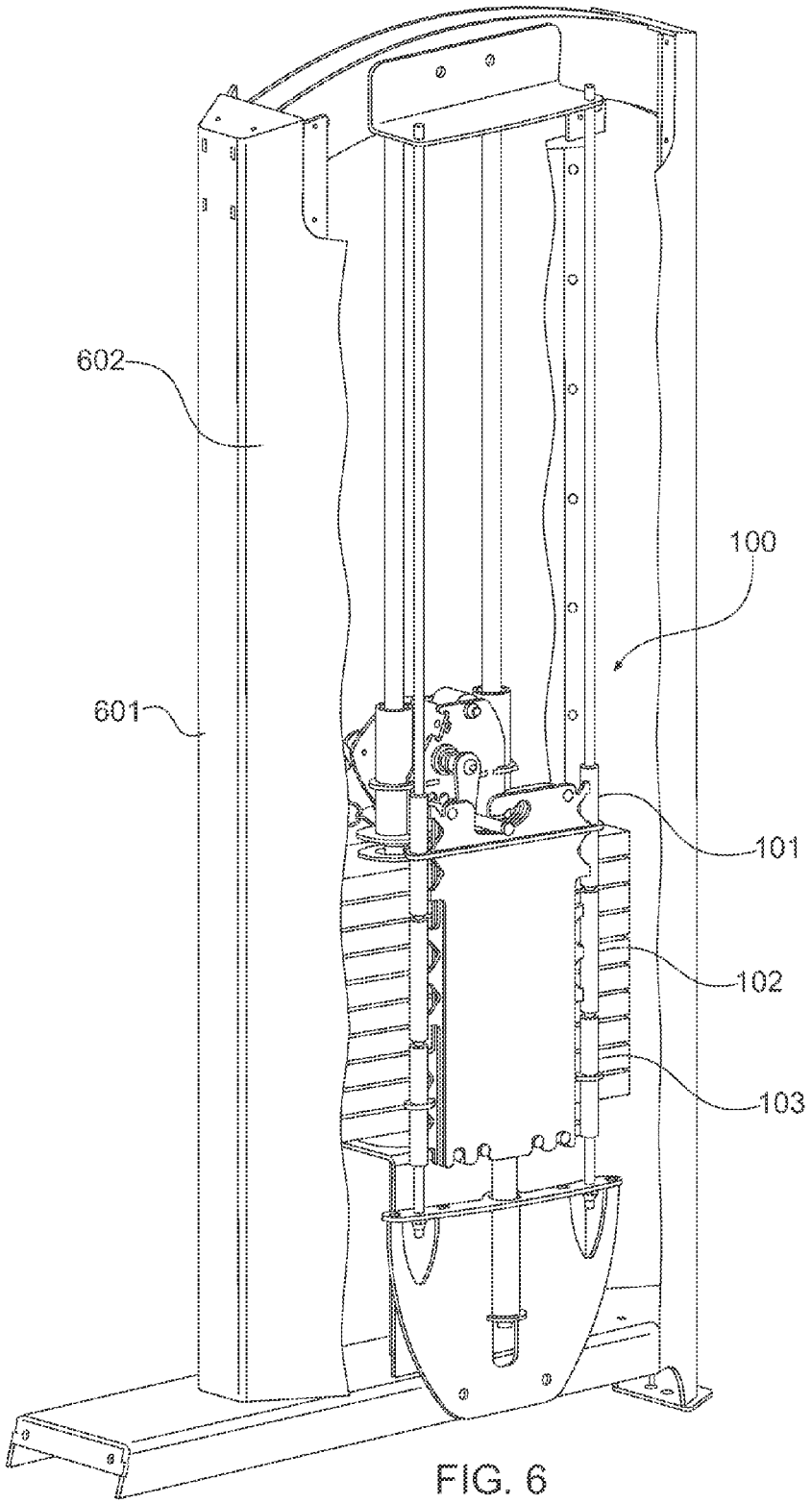
FIG. 6 is a perspective view of a weight stack system in accordance with one aspect of the invention.

FIG. 6 depicts the supplemental weight system 100 in an exercise machine 601. The exercise machine 601 can have a cover 602 which can protect the supplemental weight system 100 from damage or misuse.

Figure 7:
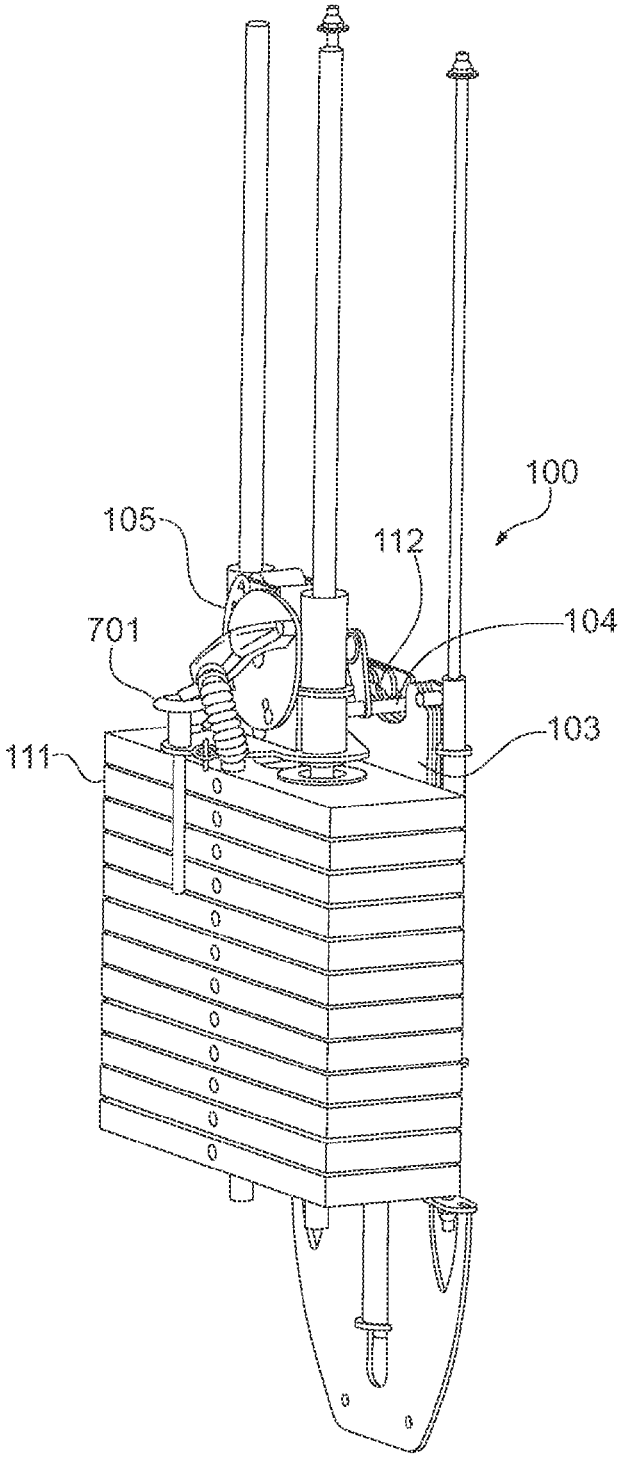
FIG. 7 is a perspective view of a weight stack system in accordance with one aspect of the invention.

FIG. 7 is a perspective view of the supplemental weight stack system 100 with a primary weight stack 111. The adjustment mechanism 105 is shown as a handle, but can be any mechanism capable of obtaining user input including a lever, buttons, screen, wheel, etc. The adjustment mechanism 105 can rely on mechanical resistance to remain in position, or can lock in position through any known methods. For example, the adjustment mechanism 105 could have a spring-loaded dowel, in the handle for example, and the user would need to pull on the handle to release the adjustment mechanism 105 from its locked position. The adjustment mechanism 105 can also lock in place through the use of cotter pins or any other known mechanisms for locking a handle in place. The resistance mechanism could also be in the engagement mechanism 104, where the mechanism is capable of moving in the downward position. As the adjustment mechanism 105 is actuated and the engagement mechanism 104 traverses the slots, a peak in the slot could push the engagement mechanism 104 downward. When the next weight is selected or unselected, the engagement mechanism 104 is pushed upward and secures the weights.

FIG. 7 also shows a weight system 100 with a pin 701 as the primary weight stack engagement mechanism 202, which engages the main weight stack 111. The weight system 100 can be provided with a place to hold the primary weight stack engagement mechanism 202, as shown in FIG. 7, such that if a user wanted to rely solely on the supplemental weights 101, 102, 103 for resistance, the user could do so by placing the primary weight stack 111 engagement mechanism 202 in the storage or holding position. The user could then use the adjustment mechanism 105 to select only supplemental weights 101, 102, 103. It is also preferred that the supplemental weight stack system 100 and weight stack 111 are engageable on the same side, as shown in FIG. 7. This is simpler for the user and prevents the user from unnecessarily reaching around the weight stacks to make adjustments.

Figure 8:
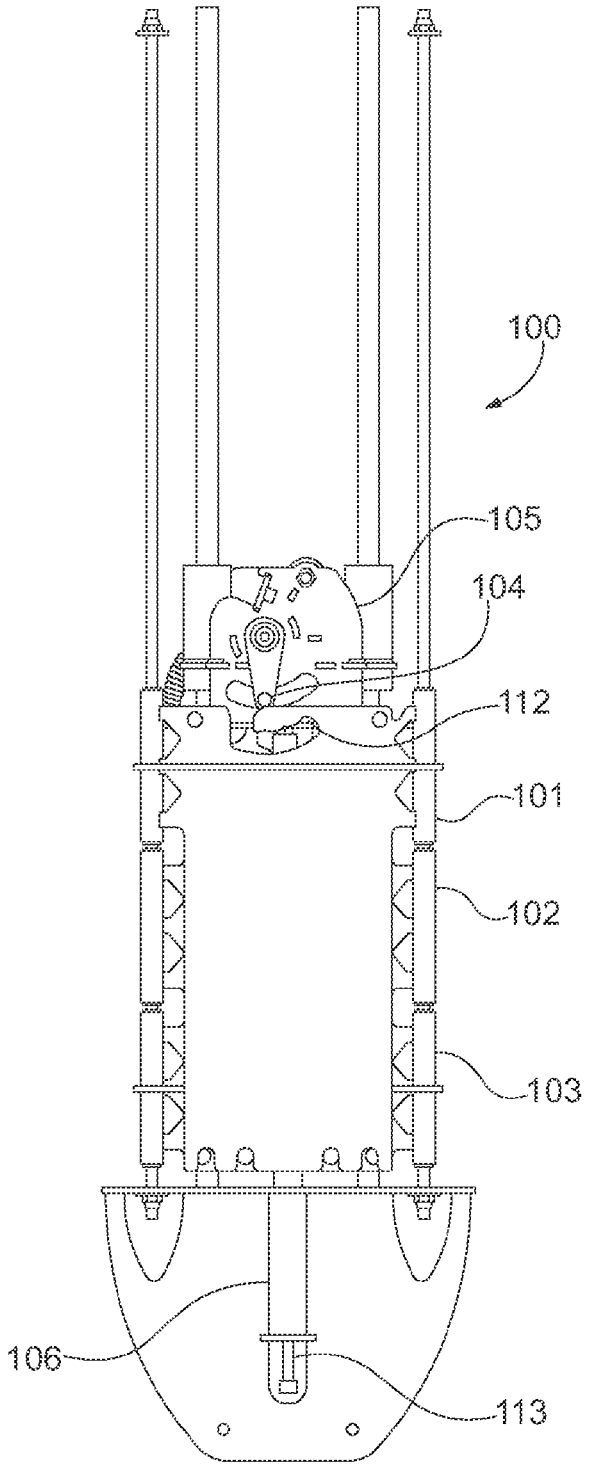
FIG. 8 is a front view of a weight stack system in accordance with one aspect of the invention.
Figure 9:
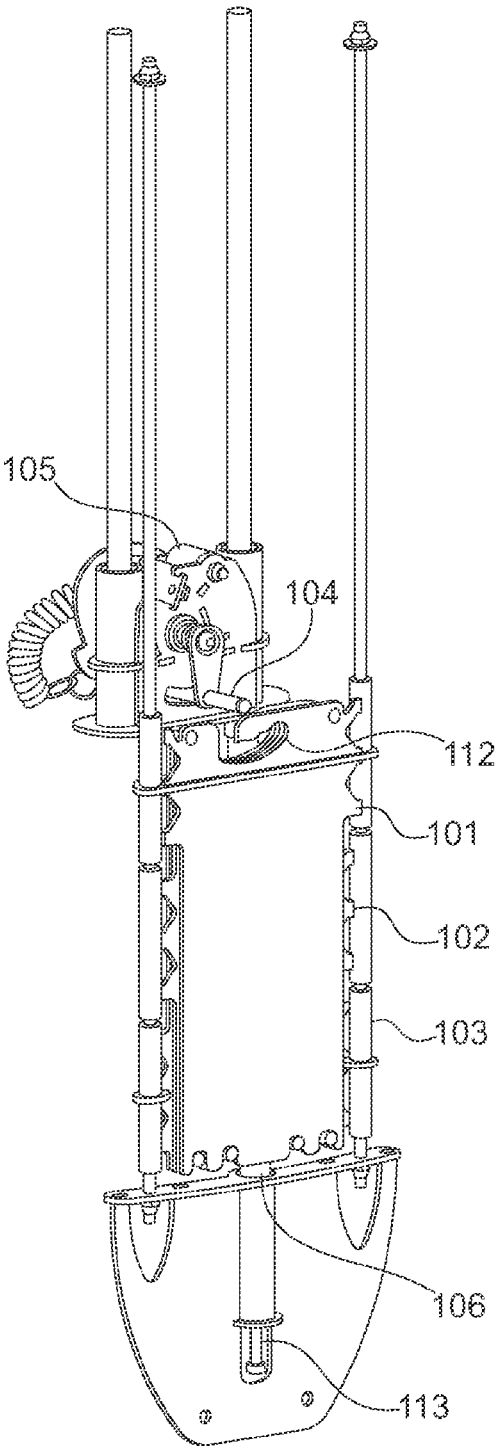
FIG. 9 is a perspective view of a weight stack system in accordance with one aspect of the invention.

FIGS. 8 and 9 provide preferred, but non-limiting, aspects of the safety features. In comparing FIGS. 8 and 9 with FIGS. 4 and 6, the most notable difference is that the engagement mechanism 104 is not engaged with the receiver 112. This is unlikely to occur, but can happen through user or machine failure. In order to prevent damage, the weights 101, 102, 103 are likely to fall and contact the catch mechanism 106. As discussed above, the catch mechanism 106 can be a shock-absorbent or elastic material, or it can contain a safety mechanism 113. When a safety mechanism 113 is used, the impact from the weights 101, 102, 103 force the safety mechanism 113 to eject from the catch mechanism 106. The safety mechanism can thus absorb part, if not all, of the impact from the falling weights. The safety mechanism 113 could be a disposable, single use item, or it could be reset by including teeth, hooks, ridges, grooves, latches, etc. on the safety mechanism 113 or catch mechanism 106.

Figure 10:
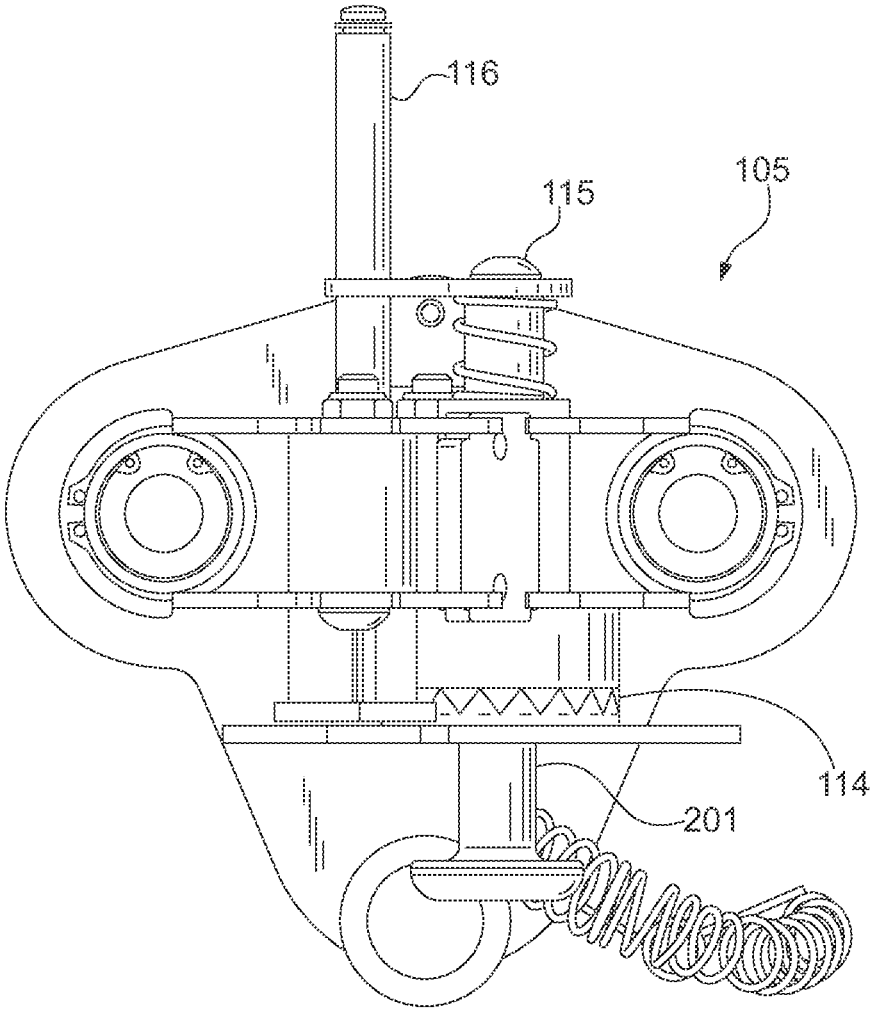
FIG. 10 is a front view of an alternative aspect of an adjustment mechanism.

FIG. 10 shows a preferred, but non-limiting, aspect of the adjustment mechanism 105. In this aspect, the adjustment mechanism 105 includes teeth 114, but any corresponding pattern which locks in place will suffice. For example, the teeth 114 could be a series of squares or curves which engage one another. In this aspect, the handle 201 can be more pin shaped, but it could also be a traditional handle as shown in the previous aspects. The adjustment mechanism 105 can include a spring-loaded guide rod 115 as well as a secondary guide rod 116.

Figure 11:
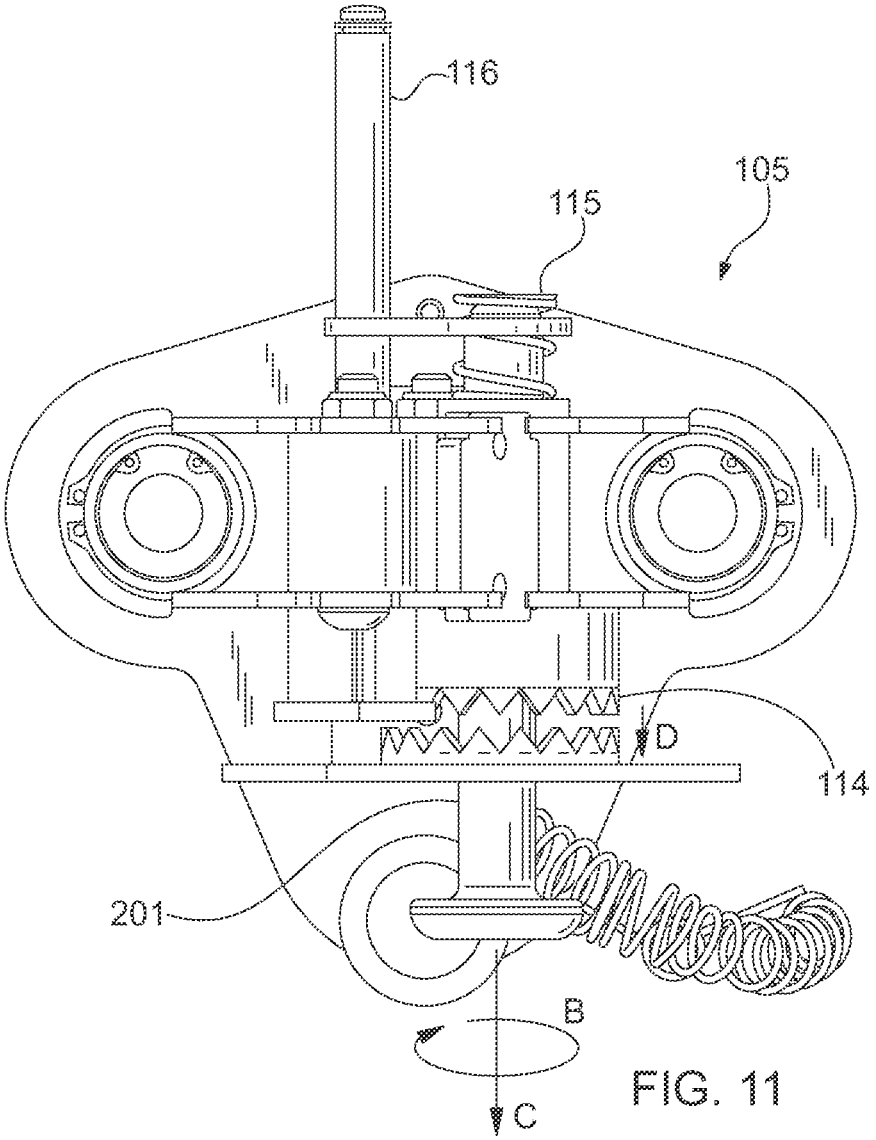
FIG. 11 is a front view of an alternative aspect of an adjustment mechanism.

As seen in FIG. 11, in order to change the adjustment mechanism 105, a user would pull the handle 201 in direction C and rotate it along or opposite to direction B. The motion of pulling on the handle will separate the teeth 114 along direction D, as well as compressing the spring-loaded guide rod 115 and moving the guide rod 116. As the handle 201 is rotated along or opposite to direction B, the engagement mechanism (not shown) can move along its path. Once the correct position is selected, the user can release the handle 201 and the spring-loaded guide rod 115 will return the adjustment mechanism 105 to the position of FIG. 10.

Figure 12:
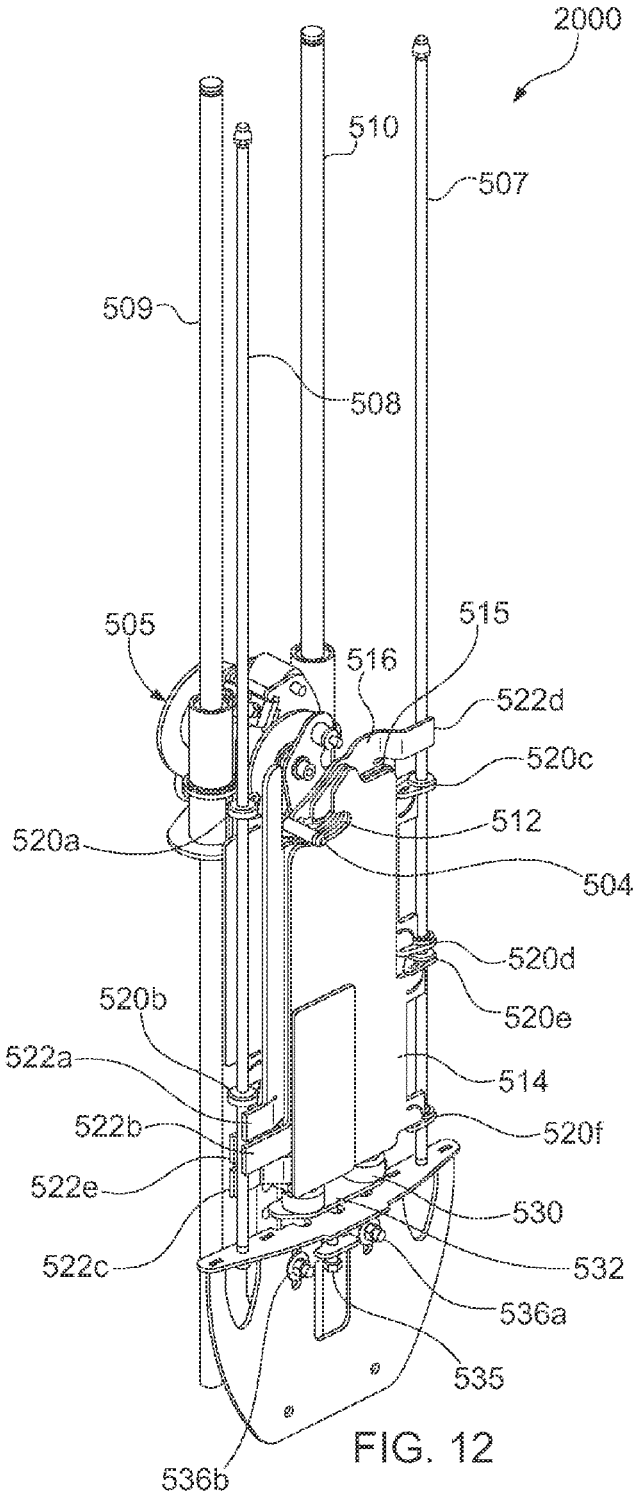
FIG. 12 is a perspective view of a weight stack system in accordance with an alternative aspect of the invention.
Figure 13:
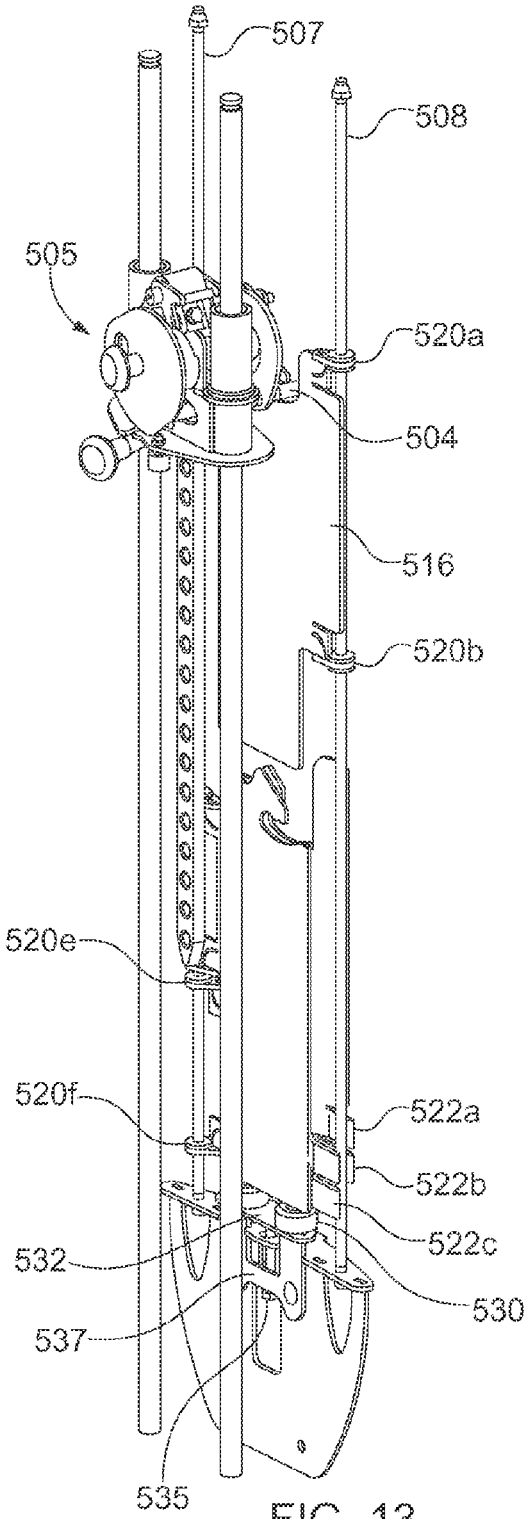
FIG. 13 is another perspective view of a weight stack system in accordance with an alternative aspect of the invention.

Referring now to FIG. 12 and FIG. 13, a supplemental weight stack system 2000 in accordance with an alternative aspect of the invention is shown. Similar to weight stack system 100 described above, weight stack system 2000 includes a plurality of engageable weights 514, 515, 516, which are configured to move up and down along respective guides 507, 508 when selectively engaged within a receiver 512 by engagement mechanism 504, wherein engagement mechanism 504 is coupled to an adjustment mechanism 505. Thus, adjustment mechanism 505 is configurable to engage none, some, or all of weights 514, 515, 516, depending upon the user's selection. As illustrated in FIG. 13, any of selected weights 514, 515, 516 will slide up and down respective guides 507, 508 as adjustment mechanism 505 concurrently slides up and down respective guides 509, 510 with the primary, vertically-stacked weights (not shown). It is to be understood that more or fewer engageable weights are possible and within the scope of the invention.

Unlike weights 101, 102, 103 described above with respect to weight stack system 100, weights 514, 515, 516 are coupled to guides 507, 508 via a pair of bushings on a first side of weights 514, 515, 516, while a second side of each weight 514, 515, 516 is provided with a pair of horizontal guide plates to maintain horizontal alignment of weights 514, 515, 516. For example, FIG. 12 shows weight 516 carried along guide 508 via a pair of bushings 520*a*, 520*b*. Similarly, weight 515 is carried along guide 507 via bushings 520*c*, 520*d*, and weight 514 is also carried along guide 507 via bushings 520*e*, 520*f*. On the other hand, the side of weight 516 opposite bushings 520*a*, 520*b* comprises a horizontal guide 522*d* running along one side of guide 507, while an interposing horizontal guide (not shown in FIG. 12) is also attached to or formed on weight 516 and runs along a second side of guide 507. Similarly, weight 515 comprises a first horizontal guide 522*a* running along one side of guide 508 and a second horizontal guide 522*c* running along a second side of guide 508, and weight 514 also comprises a first horizontal guide 522*b* running along one side of guide 508 and a second horizontal guide 522*e* running along a second side of guide 508. With this configuration, weights 514, 515, 516 are able to travel up and down respective guides 507, 508 while still maintaining their horizontal relationship with respect to one another. Furthermore, by utilizing only a pair of bushings per weight, friction between weights 514, 515, 516 and guides 507, 508 is reduced, enabling the weights 519, 515, 516 to more readily slide up and down along guides 507, 508. Friction may be even further reduced by applying a friction-reducing coating or layer to the surface of each respective horizontal guides 522*a*-522*e* which may come into contact with the surface of guides 507, 508.

Referring still to FIG. 12, a height adjustment mechanism for weights 514, 515, 516 is also shown. The height adjustment mechanism comprises a vertical adjustment screw 535 and a pair of alignment pins 536*a*, 536*b*. Vertical adjustment screw 535 is configured to translate a plate 532 in an upward or downward direction, depending upon the direction the vertical adjustment screw 535 is rotated. At least one damper 530 is located on a top surface of plate 532 and is configured to support weights 514, 515, 516 when they are not in use. At least one damper 530 may also be configured to absorb any impact from weights 514, 515, 516 in the event that they are dropped or otherwise forcefully lowered. Damper 530 could be made of any appropriate material, such as rubber, plastic, etc.

FIG. 13 illustrates another view of the height adjustment mechanism described above with respect to FIG. 12. As vertical adjustment screw 535 is turned either clockwise or counterclockwise, plate 532 is able to move up or down, respectively. Plate 532 is coupled to a vertical adjustment bracket 537, which, in turn, is coupled to alignment pins 536*a*, 536*b* shown and described with respect to FIG. 12. By turning vertical adjustment screw 535, the user may adjust the location of weights 514, 515, 516 (and particularly the location of receiver 512) in relation to the engagement mechanism 504. Such a height adjustment is particularly useful if the engagement mechanism 504 and receiver 512 become misaligned, as any misalignment could prevent or restrict engagement of one or more of weights 514, 515, 516 by engagement mechanism 504.

Figure 14:
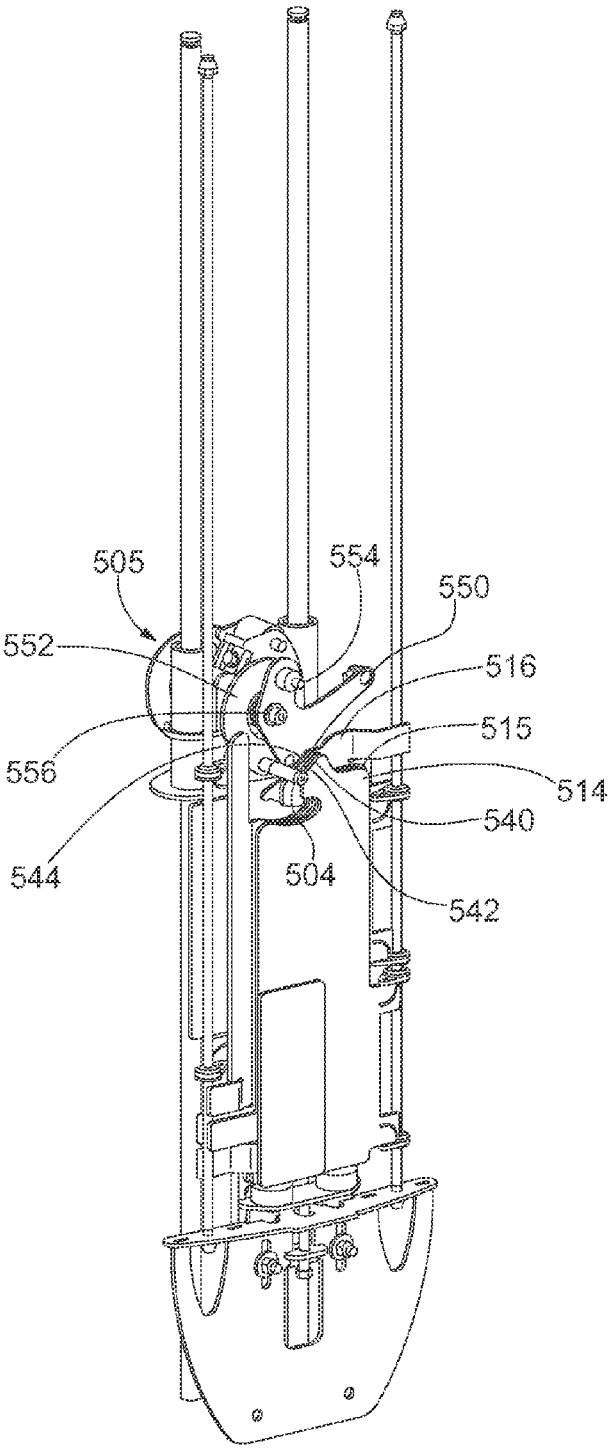
FIG. 14 is a perspective view of an adjustment mechanism in accordance with an alternative aspect of the invention.

Next, referring to FIG. 14, a perspective view of adjustment mechanism 505 in accordance with an alternative aspect of the invention is shown. As with adjustment mechanism 105 described above, adjustment mechanism 505 may include a handle which is capable of being rotated and/or pulled to allow for selection of a chosen supplemental weight or weights via engagement mechanism 504 within receiver 512. Ideally, the use of adjustment mechanism 505 is restricted to times when the primary weights are in their resting position (i.e., not in use). However, while unlikely, it would be possible for the user (or another individual) to attempt to utilize adjustment mechanism 505 when the primary weights are in use, away from their resting position. In such an instance, turning of the handle of adjustment mechanism 505 would result in rotation of engagement mechanism 504, but rotated engagement mechanism 504 would be located above receiver 512 and would, therefore, be unable to engage any of the weights 514, 515, 516. As the primary weights (and adjustment mechanism 505) travel back downward toward their resting position, the rotated engagement mechanism would contact a top surface of one or more of weights 514, 515, 516, causing potential damage to the engagement mechanism 504, the weights 514, 515, 516, or other components of the weight stack system 2000. Accordingly, a safety mechanism to prevent or lessen potential damage to the engagement mechanism 504 and/or weights 514, 515, 516 is provided with adjustment mechanism 505.

In the event that adjustment mechanism 505 is rotated while the primary weights are in use and engagement mechanism 504 strikes or otherwise contacts weights 514, 515, 516 as the primary weights are lowered (as depicted in FIG. 14), adjustment mechanism 505 is configured so as to allow engagement mechanism 504 to ride along respective ramps 540, 542, 544 formed on weights 514, 515, 516. More specifically, engagement mechanism 504 is coupled to a lever arm 552 which pivots along a rotational axis 554, wherein lever arm 552 is pivotally coupled to a bell crank 550. Bell crank 550 is rotationally coupled to the handle of adjustment mechanism 505 about a pivot axis 556, such that rotation of the handle correspondingly rotates both bell crank 550 and lever arm 552 (and attached engagement mechanism 504) during normal use. However, in the event that engagement mechanism strikes or otherwise contacts ramps 540, 542, 544, lever arm 552 is configured to rotate away from bell crank 550 to allow engagement pin 504 to ride along ramps 540, 542, 544 and prevent or restrict damage to the various components.

Figure 15:
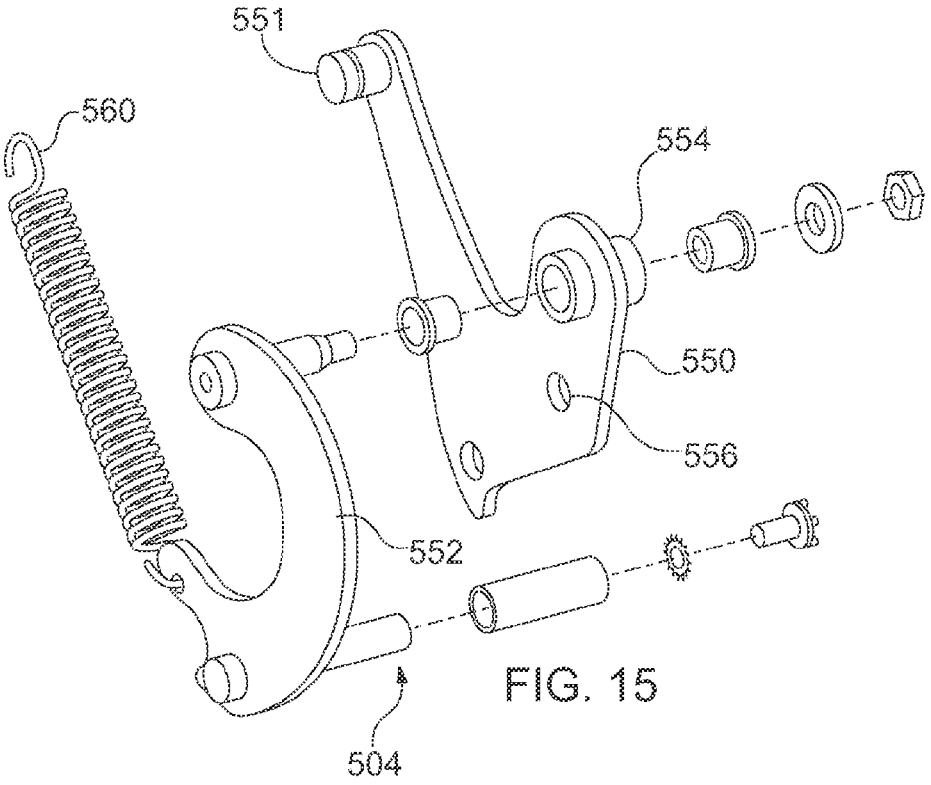
FIG. 15 is an exploded view of a portion of the adjustment mechanism shown in FIG. 14.

As FIG. 15 shows, lever arm 552 is pivotally coupled to bell crank 550 about a pivot axis 554. Lever arm 552 is further coupled to bell crank 550 by a spring 560, with one end of spring 560 attached to lever arm 552 and the other end of spring 560 attached to the bell crank 550 at an attachment point 551. While spring 560 is biased to enable lever arm 552 to rotate with bell crank 550 during normal operation of adjustment mechanism 505, spring 560 also provides a flexible connection between lever arm 552 and bell crank 550 to enable lever arm 552 (and attached engagement mechanism 504) to rotate in an opposite direction in the event that engagement mechanism 504 strikes or otherwise contacts ramps 540, 542, 544. As noted above, this configuration operates to prevent or restrict damage to various components of the weight stack system.

The preferred aspects of the invention have been described in detail herein. However, it will be appreciated by those skilled in the art that various modifications and alternatives to the preferred aspects may be made to the invention without departing from the concepts disclosed in the foregoing description. Such modifications are to be considered as included within the following claims unless the claims, by their language, expressly state otherwise. Accordingly, the particular aspects described in detail hereinabove are illustrative only and are not limiting as to the scope of the invention, which is to be given the full breadth of the appended claims and any and all equivalents thereof.

The invention claimed is:

1. A weight system comprising:

a. an engagement mechanism;

b. an adjustment mechanism capable of actuating the engagement mechanism; and c. at least one weight adapted to receive the engagement mechanism, the at least one weight having a top, a bottom, and two sides, and, a vertical axis from the top to the bottom, wherein the engagement mechanism traverses the at least one weight in a circular motion about an axis substantially perpendicular to the vertical axis, and wherein the adjustment mechanism is vertically movable in conjunction with the at least one weight.

2. The weight system of claim 1, wherein the at least one weight comprises a receiver formed therein to receive the engagement mechanism as the engagement mechanism traverses the at least one weight.

3. The weight system of claim 1, further comprising a plurality of weights adapted to receive the engagement mechanism, each weight having a top, a bottom, and two sides, and, a vertical axis from the top to the bottom, wherein the engagement mechanism traverses each weight in a circular motion substantially perpendicular to the vertical axis.

4. The weight system of claim 3, wherein the engagement mechanism traverses each of the plurality of weights sequentially.

5. The weight system of claim 4, wherein as the engagement mechanism traverses each of the plurality of weights, the weights cumulatively engage the engagement mechanism such that more than one weight acts upon the engagement mechanism.

6. The weight system of claim 3, wherein the plurality of weights are stacked horizontally.

7. The weight system of claim 3, wherein each of the plurality of weights further comprises at least one stop pin.

8. The weight system of claim 3, further comprising a catch mechanism.

9. The weight system of claim 8, wherein the catch mechanism further comprises a safety mechanism.

10. The weight system of claim 3, wherein each of the plurality of weights further comprises a pair of bushings located on a first side of the weight.

11. The weight system of claim 10, wherein each of the plurality of weights further comprises a pair of horizontal guide plates located on a second side of the weight opposite the first side of the weight.

12. The weight system of claim 1, further comprising a vertical adjustment mechanism capable of adjusting the vertical position of the at least one weight.

13. The weight system of claim 1, wherein the adjustment mechanism further comprises a plurality of teeth which are engageable with a handle.

14. A method for engaging a weight stack comprising the steps of:

a. providing an adjustment mechanism capable of actuating an engagement mechanism, whereby the engagement mechanism is capable of acting in a circular motion about an axis substantially perpendicular to a vertical axis upon a plurality of weights;

b. actuating the engagement mechanism via the adjustment mechanism, wherein actuating the adjustment mechanism comprises rotating the adjustment mechanism in a substantially circular motion; and c. engaging at least one weight with the engagement mechanism, wherein the adjustment mechanism is vertically movable in conjunction with the plurality of weights.

15. The method for engaging a weight stack as in claim 14, further comprising:

d. engaging a second weight with the engagement mechanism, wherein the engagement mechanism acts upon the first and second weights.

16. A weight system comprising:

a. an engagement mechanism;

b. an adjustment mechanism capable of actuating the engagement mechanism; and c. at least one weight adapted to receive the engagement mechanism, the one weight having a top, a bottom, and two sides, and, a vertical axis from the top to the bottom, wherein the adjustment mechanism comprises a safety mechanism capable of displacing the engagement mechanism in an event that the engagement mechanism contacts the top of the at least one weight, wherein the engagement mechanism traverses the at least one weight in a circular motion about an axis substantially perpendicular to the vertical axis; and wherein the top of the at least one weight comprises at least one ramp surface capable of displacing the engagement mechanism.

17. The weight system of claim 16, wherein the safety mechanism comprises a lever arm and a bell crank, wherein the lever arm is pivotally coupled to the bell crank.

18. The weight system of claim 17, wherein the lever arm is further coupled to the bell crank via a spring.

19. The weight system of claim 17, wherein the engagement mechanism is coupled to the lever arm.

* * * * *